US007987762B2

(12) United States Patent
Joynt et al.

(10) Patent No.: US 7,987,762 B2
(45) Date of Patent: Aug. 2, 2011

(54) APPARATUS FOR DEFEATING HIGH ENERGY PROJECTILES

(75) Inventors: Vernon P. Joynt, Pretoria (ZA); Robert A. Cole, Johns Island, SC (US); Thomas E. Borders, Goose Creek, SC (US)

(73) Assignee: Force Protection Technologies, Inc., Ladson, SC (US)

( * ) Notice: Subject to any disclaimer, the term of this patent is extended or adjusted under 35 U.S.C. 154(b) by 40 days.

(21) Appl. No.: 12/385,850

(22) Filed: Apr. 22, 2009

(65) Prior Publication Data

US 2010/0294123 A1 Nov. 25, 2010

(51) Int. Cl.
*F41H 5/02* (2006.01)

(52) U.S. Cl. ..... 89/36.02; 89/36.07; 89/36.09; 89/912; 89/929; 428/911

(58) Field of Classification Search ..... 89/36.02, 89/36.07–36.09; 428/911
See application file for complete search history.

(56) References Cited

U.S. PATENT DOCUMENTS

| | | | | |
|---|---|---|---|---|
| 4,987,033 | A | 1/1991 | Abkowitz et al. | |
| 5,723,807 | A | 3/1998 | Kuhn, II | |
| 6,053,993 | A | 4/2000 | Reichman et al. | |
| 6,268,301 | B1 | 7/2001 | Dalman et al. | |
| 6,920,817 | B2 * | 7/2005 | Ravid et al. | 89/36.11 |
| 6,962,102 | B1 * | 11/2005 | Johnston et al. | 89/36.17 |
| 7,082,868 | B2 * | 8/2006 | Reichman | 89/36.02 |
| 7,225,717 | B2 | 6/2007 | Williams | |
| 7,383,761 | B2 * | 6/2008 | Warren et al. | 89/36.02 |
| 7,401,540 | B1 * | 7/2008 | Kocher | 89/36.08 |
| 7,500,422 | B2 * | 3/2009 | Mazur | 89/36.02 |
| 7,543,523 | B2 * | 6/2009 | Hunn | 89/36.02 |
| 7,588,071 | B2 * | 9/2009 | Kang | 164/463 |
| 7,601,416 | B2 * | 10/2009 | Palley | 428/171 |
| 7,604,876 | B2 * | 10/2009 | Collier et al. | 428/698 |
| 7,631,405 | B2 * | 12/2009 | Ritter et al. | 28/103 |
| 2007/0017360 | A1 | 1/2007 | Cohen | |

OTHER PUBLICATIONS

International Search Report in PCT/US09/42058 dated Apr. 29, 2009, 4 pages.
Written Opinion of Internation Searching Authority in PCT/US09/42058 dated Apr. 29, 2009, 7 pages.

* cited by examiner

*Primary Examiner* — Bret Hayes
*Assistant Examiner* — Michael D David
(74) *Attorney, Agent, or Firm* — Finnegan, Henderson, Farabow, Garrett & Dunner, L.L.P.

(57) ABSTRACT

A armor system for protecting a vehicle from a projectile, the projectile having an expected trajectory and the vehicle having a hull, is disclosed. The armor system has a modular armor subsystem configured to be mounted exterior to the vehicle hull. The modular armor subsystem has a leading layer having metal, leading relative to the expected projectile trajectory, and an intermediate sheet-like layer having low density material, of a density less than metal, abutting a rear surface of the leading layer. The armor system also has an intermediate sheet-like layer having glass fiber material and abutting a rear surface of the intermediate low density material layer, and an intermediate sheet-like layer having metal and abutting a rear surface of the intermediate glass fiber layer.

27 Claims, 6 Drawing Sheets

APPARATUS FOR DEFEATING HIGH ENERGY PROJECTILES

TECHNICAL FIELD

The present disclosure relates to an armor system that resists penetration by projectiles.

BACKGROUND

Conventional armor may be subjected to a variety of projectiles designed to defeat the armor by either penetrating the armor with a solid or jet-like object or by inducing shock waves in the armor that are reflected in a manner to cause spalling of the armor such that an opening is formed and the penetrator (usually stuck to a portion of the armor) passes through the armor, or an inner layer of the armor spalls and is projected at high velocity without physical penetration of the armor.

Some anti-armor weapons are propelled to the outer surface of the armor where a shaped charge is exploded to form a generally linear "jet" of metal that will penetrate solid armor. Such weapons are often called Hollow Charge ("HC") weapons. A rocket propelled grenade ("RPG") is such a weapon. An RPG 7 is a Russian origin weapon that produces a penetrating metal jet, the tip of which hits the target at about 8000 m/s. When encountering jets at such velocities, solid metal armors behave more like liquids than solids. Irrespective of their strength, they are displaced radially and the jet penetrates the armor.

Various protection systems are effective at defeating HC jets. Amongst different systems, the best known are reactive armors that use explosives in the protection layers that detonate on being hit to break up most of the HC jet before it penetrates the target. Such systems are often augmented by what is termed "slat armor," a plurality of metal slats disposed outside the body of the vehicle to prevent the firing circuit of an RPG from functioning.

A second type of anti-armor weapon uses a linear, heavy metal penetrator projected at a high velocity to penetrate the armor. This type of weapon is referred to as EFP (explosive formed projectile) or SFF (self forming fragment), sometimes referred to as a "pie charge" or a "plate charge.

In some of these weapons the warhead behaves as a hybrid of the HC and the EFP and produces a series of metal penetrators projected in line towards the target. Such a weapon will be referred to herein as a Hybrid warhead. Hybrid warheads behave according to how much "jetting" or HC effect the hybrid warhead has, and up to how much of a single, large penetrator-like EFP it produces.

Another type of anti-armor weapon propels a relatively large, heavy, generally ball-shaped solid projectile (or a series of multiple projectiles) at high velocity. When the ball-shaped metal projectile(s) hits the armor, the impact induces shock waves that reflect in a manner such that a plug-like portion of the armor is sheared from the surrounding material and is projected along the path of the metal projectile(s), with the metal projectile(s) attached thereto. Such an occurrence can, obviously, have very significant detrimental effects on the systems and personnel within a vehicle having its armor defeated in such a manner.

While the HC type weapons involve design features and materials that dictate they be manufactured by an entity having technical expertise, the latter type of weapons (EFP and Hybrid) can be constructed from materials readily available in a combat area. For that reason, and the fact that such weapons are effective, these weapons have proven troublesome to vehicles using conventional armor.

The penetration performance for the three mentioned types of warheads is normally described as the ability to penetrate a solid amount of RHA (Rolled Homogeneous Armor) steel armor. Performances typical for the weapon types are: HC warheads may penetrate 1 to 3 ft thickness of RHA; EFP warheads may penetrate 1 to 6 inches of RHA; and Hybrids warheads may penetrate 2 to 12 inches thick RHA. These estimates are based on the warheads weighing less than 15 lbs and being fired at their best respective optimum stand off distances. The diameter of the holes made through the first inch of RHA would be: HC up to an inch diameter hole; EFP up to a 9 inch diameter hole; and Hybrids somewhere in between. The best respective optimum stand off distances for the different charges are: an HC charge is good under 3 feet, but at 10 ft or more it is very poor; for an EFP charge a stand off distance up to 30 feet produces almost the same (good) penetration and will only fall off significantly at very large distances such as 50 yards; and for Hybrid charges penetration is good at standoff distances up to 10 ft, but after 20 feet penetration falls off significantly. The way these charges are used is determined by these standoff distances and the manner in which their effectiveness is optimized (e.g., the angles of the trajectory of the penetrator to the armor). These factors affect the design of the protection armor.

While any anti-armor projectile can be defeated by armor of sufficient strength and thickness, extra armor thickness is heavy and expensive, adds weight to the armored vehicle using it, which, in turn, places greater strain on the vehicle engine and drive train, and thus has a low "mass efficiency."

Armor solutions that offer a weight advantage against these types of weapons can be measured in how much weight of RHA it saves when compared with the RHA needed to stop a particular weapon penetrating. This advantage can be calculated as a protection ratio, the ratio being equal to the weight of RHA required to stop the weapon penetrating, divided by the weight of the proposed armor system that will stop the same weapon. Such weights are calculated per unit frontal area presented in the direction of the anticipated trajectory of the weapon.

Thus, there exists a need for an armor that can defeat the high energy projectiles (i.e., projectiles having velocities of greater than about 2500 m/s) from anti-armor devices without requiring excess thicknesses of armor, and thus have a high mass efficiency. Such armor may be made of materials that can be readily fabricated and incorporated into a vehicle design at a reasonable cost, and may be added to existing vehicles.

The present disclosure is directed to overcoming shortcomings and/or other deficiencies in existing technology.

SUMMARY OF THE DISCLOSURE

In accordance with one aspect, the present disclosure is directed toward an armor system for protecting a vehicle from a projectile, the projectile having an expected trajectory and the vehicle having a hull. The armor system includes a modular armor subsystem configured to be mounted exterior to the vehicle hull. The modular armor subsystem includes a leading layer having metal, leading relative to the expected projectile trajectory, and an intermediate sheet-like layer having low density material, of a density less than metal, abutting a rear surface of the leading layer. The armor system also includes an intermediate sheet-like layer having glass fiber material and abutting a rear surface of the intermediate low density material layer, and an intermediate sheet-like layer having metal and abutting a rear surface of the intermediate glass fiber layer.

According to another aspect, the present disclosure is directed toward an armor system for protecting a vehicle from a projectile, the projectile having an expected trajectory and the vehicle having a hull. The armor system includes a modular armor subsystem configured to be mounted exterior to the vehicle hull. The modular armor subsystem includes a leading layer, relative to the expected projectile trajectory and having metal, and an intermediate sheet-like layer having low density material, of a density less than metal, abutting a rear surface of the leading layer. The modular armor subsystem also includes an intermediate sheet-like layer having glass fiber material and abutting a rear surface of the intermediate low density material layer, and a first intermediate sheet-like layer having metal and abutting a rear surface of the intermediate glass fiber layer. The modular armor subsystem further includes a second intermediate sheet-like layer having metal and abutting a rear surface of the first intermediate metal layer.

DETAILED DESCRIPTION

Figure 1:
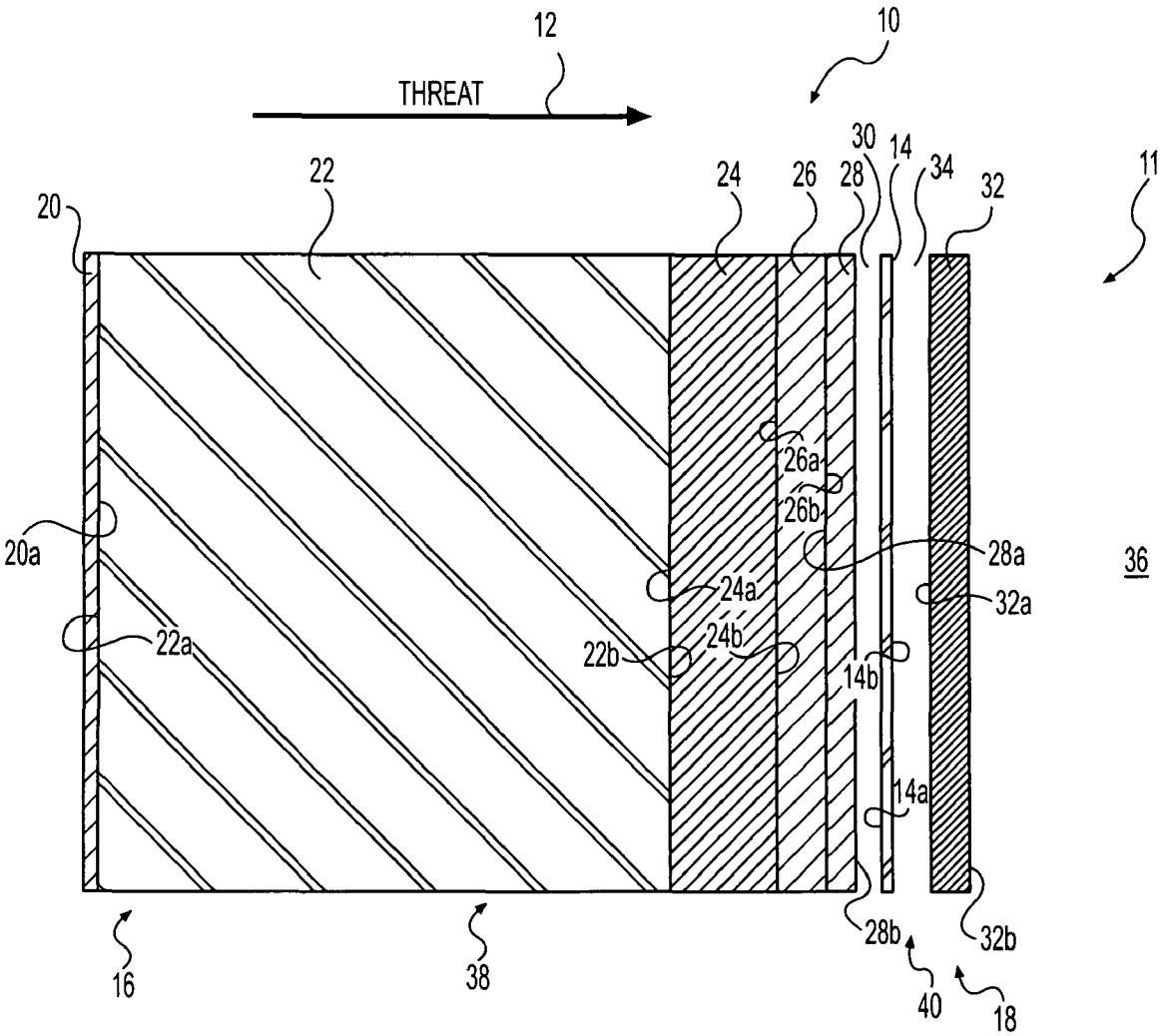
FIG. 1 is a schematic, cross-sectional view of a first exemplary disclosed armor system.

FIG. 1 illustrates an exemplary disclosed armor system 10 for protecting a vehicle 11 (shown in FIG. 3) from projectiles such as, for example, HC, EFP, and Hybrid warheads. In the following discussion, the projectile has an expected trajectory 12 relative to vehicle 11. Trajectory 12 establishes a direction for understanding certain terms used in the following discussion (e.g., "leading," "rear," "behind," "front," etc.), describing the components of armor system 10 that the projectile successively confronts as it approaches a vehicle hull 14. Moreover, the terms "exterior" and "interior," as used in conjunction with the vehicle hull 14, are given their usual meanings (i.e., "exterior" is in front of hull 14 relative to trajectory 12, and "interior" is behind hull 14 relative to trajectory 12).

Armor system 10 may include an exterior armor subsystem 16 and an interior armor subsystem 18. Exterior armor subsystem 16 may include a leading sheet-like layer 20 having metal. Exterior armor subsystem 16 may also include an intermediate sheet-like layer 22 having material of a density that is lower than metal, where a front surface 22*a* of layer 22 may abut a rear surface 20*a* of layer 20. Exterior armor subsystem 16 may further include an intermediate sheet-like layer 24 having glass fiber material, where a front surface 24*a* of layer 24 may abut a rear surface 22*b* of layer 22. Exterior armor subsystem 16 may also include an intermediate sheet-like layer 26 having metal, where a front surface 26*a* of layer 26 may abut a rear surface 24*b* of layer 24. Exterior armor subsystem 16 may further include an intermediate sheet-like layer 28 having metal, where a front surface 28*a* of layer 28 may abut a rear surface 26*b* of layer 26. A dispersion space 30 may be disposed between a rear surface 28*b* of layer 28 and a front surface 14*a* of vehicle hull 14.

Leading layer 20 may include a metal such as, for example, a high strength aluminum alloy having a tensile strength greater than 20,000 lbs./in.$^2$ and an elongation to break greater than 10%. Therefore, layer 20 may have a relatively high elongation at tensile rupture. Layer 20 may include high strength aluminum alloys such as, for example, 7039 aluminum, 5083 aluminum, 6061 aluminum, and 2024 aluminum. It is also contemplated that layer 20 may include one or more of materials such as, for example, high strength aluminum, copper, steel, stainless steel, magnesium, molybdenum, copper, zirconium, titanium, and nickel. Layer 20 may have a thickness, for example, of between about ⅛" and about ¾".

Intermediate layer 22 may include a low density material having a density lower than metal such as, for example, a low density polypropylene composite material. For example, layer 22 may include Tegris®, available from Milliken & Company, 920 Milliken Road, P.O. Box 1926, Spartansburg, S.C. 29303 USA. It is also contemplated that layer 20 may include materials selected from one or more low density materials such as, for example, Kevlar® reinforced polymer or plastics, polyethylene composites, and hybrid materials formed from one of these alternative low density materials. For example, layer 22 may be Dyneema®, available from DSM. One skilled in the art given the present disclosure may be able to search out and select other low density materials having similar properties to these exemplary materials. These exemplary materials have been found to help attenuate the high velocity jets of metals that may accompany high energy projectiles, and thus increase the chance of defeating such threats. Layer 22 may have a thickness, for example, of between about 8" and about 14".

Intermediate layer 24 may include a glass fiber material such as, for example, R-Glass composite in phenolic resin, for example ShieldStrand™ that may be obtained from OCV™ Reinforcements. For example, layer 24 may include Quicksilver™, available from AGY. It is also contemplated that layer 24 may include an S-Glass material such as, for example, S-2™ and Featherlight™, available from AGY. It is further contemplated that layer 24 may include an E-Glass composite material. It is further contemplated that layer 24 may include composite materials such as, for example, a Kevlar® reinforced polymer material that may be infused with phenolic resin, a Kevlar® woven blanket material including a plurality of plies that may be woven together, or a polyethylene composite material. It is also contemplated that layer 24 may include a carbon fiber woven blanket material. Layer 24 may have a thickness, for example, of between about ½" and about 4". It is also contemplated that layer 24 may include any hybrid composite of the above systems.

Intermediate layers 26 and 28 may include similar materials as leading layer 20. Each of layers 26 and 28 may have a thickness, for example, of between about ½" and about 2".

Dispersion space 30 may be a space between rear surface 28*b* of layer 28 and front surface 14*a* of vehicle hull 14, and may be measured in a direction generally perpendicular to parallel-aligned layer 28 and hull 14. Layer 28 may be spaced from hull 14, for example, by mechanical spacers and/or a low density foam-like material. Accordingly, dispersion space 30 may be a substantially empty space maintained via mechanical spacers, or may be substantially filled with foam-like material. It is also contemplated that both mechanical spacers and foam-like material may be disposed within dispersion space 30. The foam-like material may be any suitable foam material such as, for example, material meeting the FMVSS 302 Burn Rate Test such as EL Foam P300.

Dispersion space 30 may serve to allow significant lateral dispersion of projectile material passing therethrough, thereby impeding the penetration of the projectile material through armor system 10 in the direction of trajectory 12, and may contain a portion of the projectile material within dispersion space 30. The term "lateral" indicates a direction at an angle from the initial line of flight of the projectile (i.e. trajectory 12). As the moving material of the projectile is increasingly dispersed within dispersion space 30, the energy that the projectile exerts incident to the next successive layer (e.g., hull 14) becomes increasingly less concentrated. In addition, as the thickness of the dispersion space increases, the kinetic energy per surface area that is imparted on the successive layer (e.g., hull 14) decreases. Dispersion space 30 may have a width, for example, of between about ½" and about 2", allowing dispersion space 30 to dissipate significant amounts of kinetic energy, without resulting in an impractical overall thickness of armor system 10.

Vehicle hull 14 may include a high strength steel such as, for example, a 500 Brinell hardness steel. For example, hull 14 may include Mil A-46100 Armor Plate. Hull 14 may have a thickness, for example, of between about ¼" and about ¾".

Interior armor subsystem 18 may include an intermediate sheet-like layer 32 having polymer material. A dispersion space 34 may be disposed between a rear surface 14*b* of hull 14 and a front surface 32*a* of layer 32. A vehicle interior 36 may be enclosed by a rear surface 32*b* of layer 32.

Dispersion space 34 may be a space between rear surface 14*b* of hull 14 and front surface 32*a* of layer 32, and may be similar to dispersion space 30. Dispersion space 30 may have a width, for example, of between about ½" and about 2".

Layer 32 may include a polymer material such as, for example, a polyethylene composite material. It is also contemplated that layer 32 may include a Kevlar® reinforced polymer or plastic material available, for example, from LTC. It is also contemplated that layer 32 may include an R-Glass composite in phenolic resin of a type that may be obtained, for example, from OCV™ Reinforcements. For example, layer 32 may include Quicksilver™, available from AGY. It is also contemplated that layer 32 may include an S-Glass material such as, for example, S-2™ and Featherlight™, available from AGY. It is further contemplated that layer 32 may also include an E-Glass composite material. It is further contemplated that layer 32 may include a composite material such as, for example, a Kevlar® reinforced polymer that may be infused with phenolic resin or a Kevlar® woven blanket material including a plurality of plies that may be woven together. Layer 32 may have a thickness, for example, of between about ½" and about 2".

Figure 2:
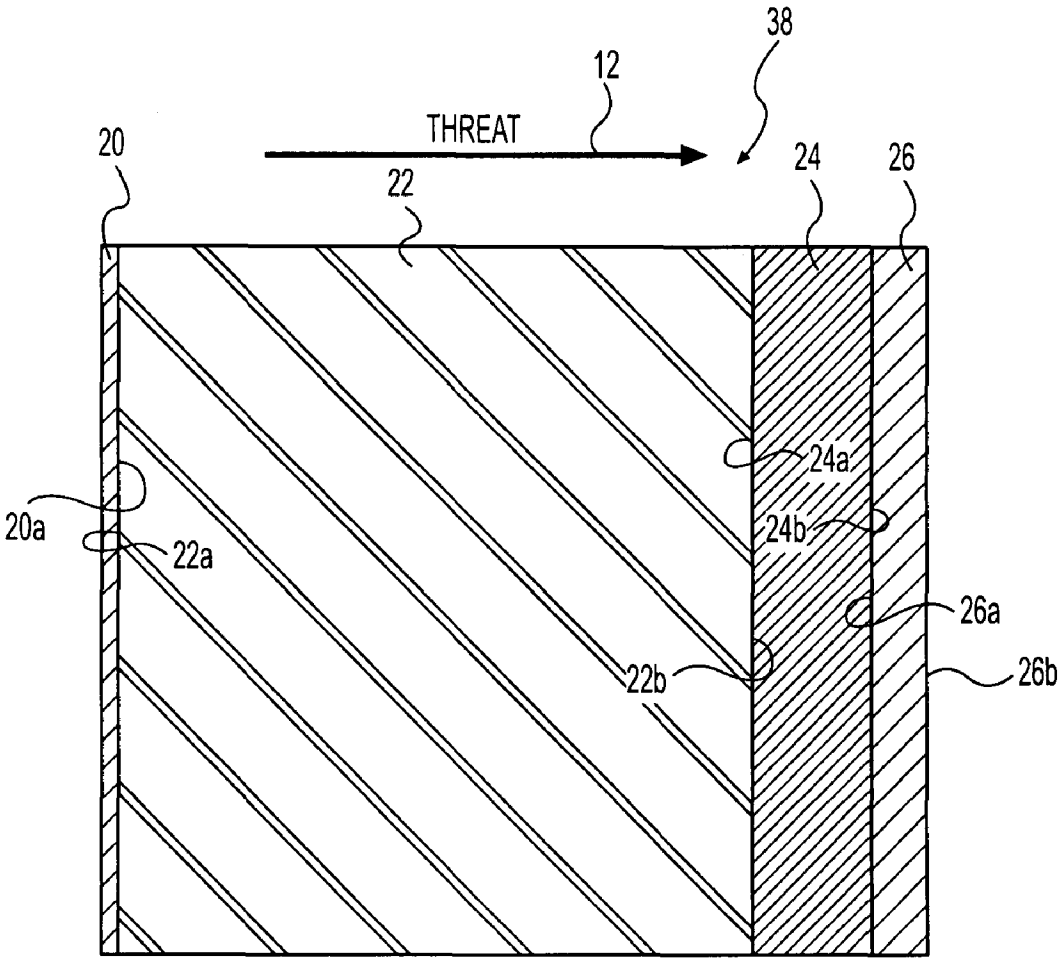
FIG. 2 is a schematic, cross-sectional view of an exemplary disclosed modular armor subsystem of the armor system of FIG. 1.

Armor system 10 of FIG. 1 may include a modular armor subsystem 38, such as illustrated in FIG. 2, which may include components of exterior armor subsystem 16. With reference to FIG. 2, modular armor subsystem 38 may include leading layer 20, intermediate layer 22, intermediate layer 24, and intermediate layer 26. Layers 20, 22, 24, and 26 may be attached to each other by any suitable method such as, for example, via adhesive having relatively high strength and relatively high elongation to break. For example, methacrylate adhesive, or any other suitable adhesive having high strength and high elongation to break, may be applied to the abutting surfaces to attach layers 20, 22, 24, and 26 to each other. Adhesive may be applied to surfaces 20*a* and/or 22*a* to attach leading layer 20 to intermediate layer 22, to surfaces 22*b* and/or 24*a* to attach intermediate layer 22 to intermediate layer 24, and to surfaces 24*b* and/or 26*a* to attach intermediate layer 24 to intermediate layer 26.

Referring back to FIG. 1, armor system 10 may also include a permanent armor subsystem 40, which may include components of both exterior armor subsystem 16 and interior armor subsystem 18. Permanent armor subsystem 40 may include intermediate layer 28, hull 14, and intermediate layer 32. Rear surface 26*b* of layer 26 of modular armor subsystem 38 may be attached to front surface 28*a* of layer 28 of permanent armor subsystem 40 by any known technique in the art such as, for example, via mechanical fasteners. For example, modular armor subsystem 38 may be bolted to permanent armor subsystem 40.

Figure 3:
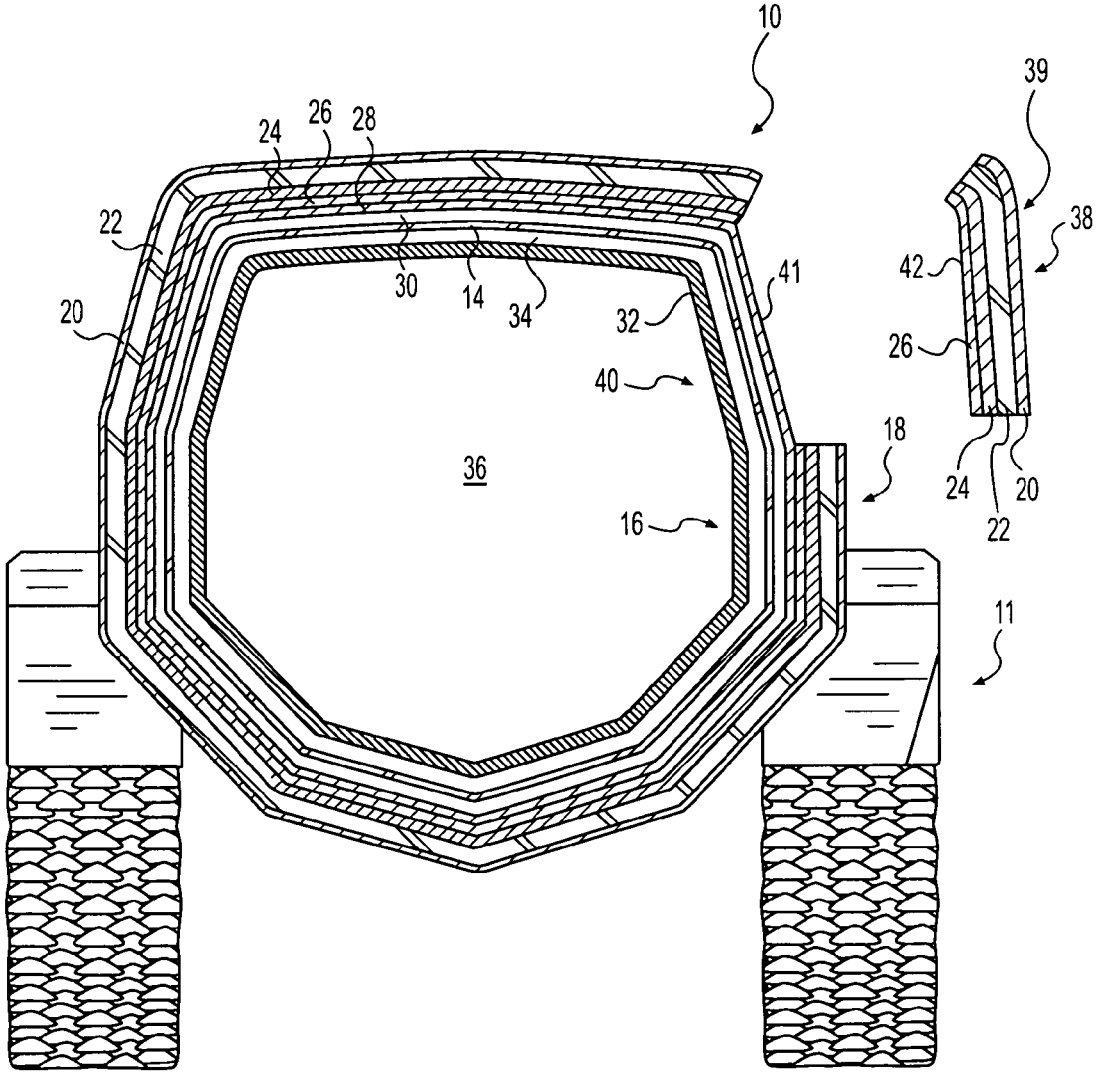
FIG. 3 is a schematic, cross-sectional view of a first exemplary disclosed vehicle.

As shown in FIG. 3, armor system 10 may be configured to protect vehicle interior 36 from projectiles. One or more panels 39 of modular armor subsystem 38 may be provided and removably attached to permanent armor subsystem 40 of vehicle 11. Panel 39 may be planar and may be removably attached to permanent armor subsystem 40 that may be disposed on a side portion of vehicle 11. A surface 41 of permanent armor subsystem 40 may be configured to receive and bear flush against a surface 42 of a given panel 39. It is contemplated that panel 39 may be non-planar and include, for example, corners or curved portions. It is also contemplated that panel 39 may be removably attached to permanent armor subsystem 40 that may be disposed on a top or bottom portion of vehicle 11.

Figure 4:
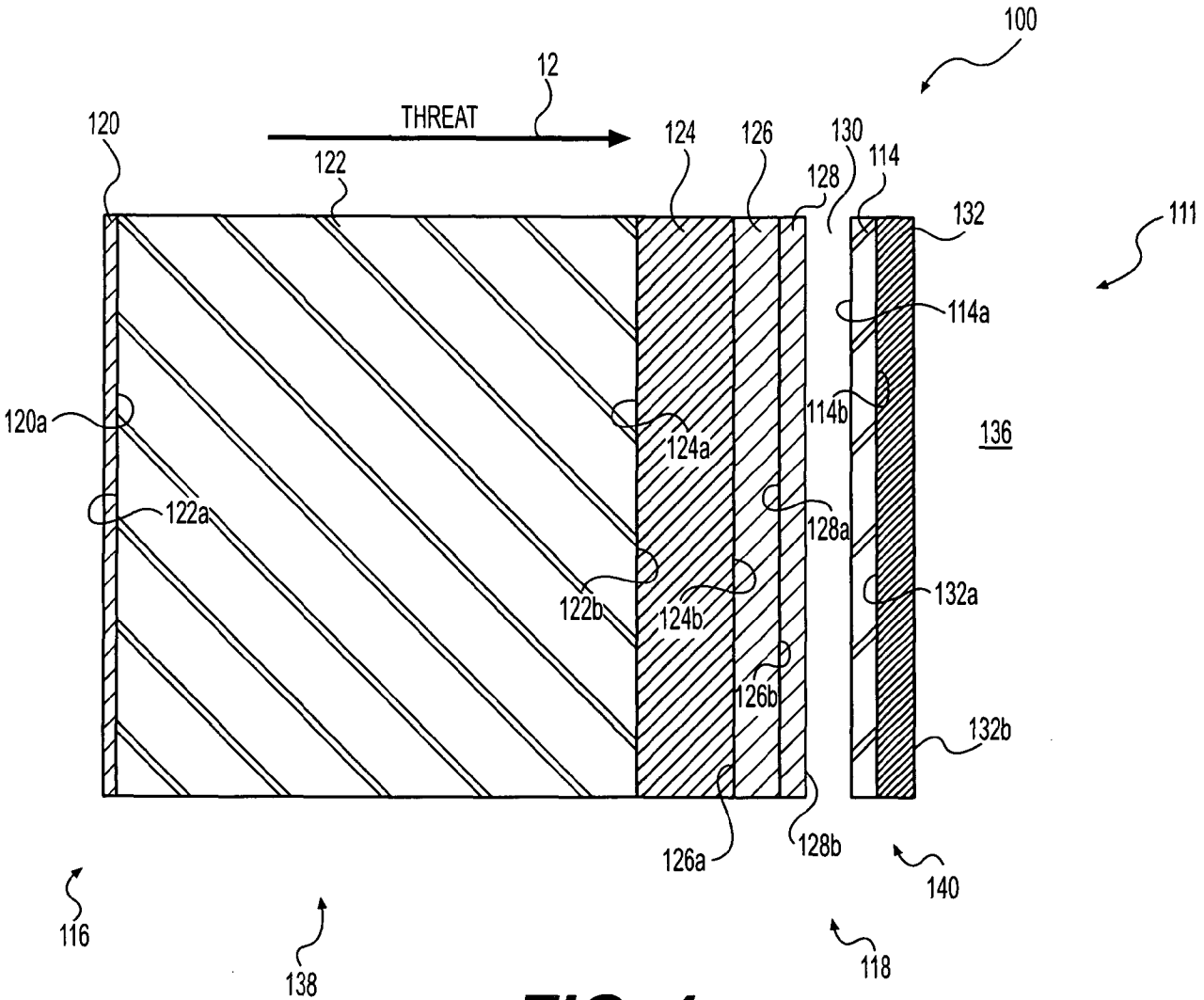
FIG. 4 is a schematic, cross-sectional view of a second exemplary disclosed armor system.

FIG. 4 illustrates another exemplary disclosed armor system 100 for protecting a vehicle 111 (shown in FIG. 6) from projectiles. Armor system 100 may include a vehicle hull 114, an exterior armor subsystem 116 and an interior armor subsystem 118. Exterior armor subsystem 116 may include a leading sheet-like layer 120 having metal that may be of a similar material as layer 20 of armor system 10. Exterior armor subsystem 116 may also include an intermediate sheet-like layer 122 having low density material that may be of a similar material as layer 22 of armor system 10. A front surface 122*a* of layer 122 may abut a rear surface 120*a* of layer 120. Exterior armor subsystem 116 may further include an intermediate sheet-like layer 124 having glass fiber material that may be of a similar material as layer 24 of armor system 10. A front surface 124*a* of layer 24 may abut a rear surface 122*b* of layer 122. Exterior armor subsystem 116 may also include an intermediate sheet-like layer 126 having metal that may be of a similar material as layer 20 of armor system 10. A front surface 126*a* of layer 126 may abut a rear surface 124*b* of layer 124. Exterior armor subsystem 116 may further include an intermediate sheet-like layer 128 having metal that may be of a similar material as layer 20 of armor system 10. A front surface 128*a* of layer 128 may abut a rear surface 126*b* of layer 126. A dispersion space 130 may be disposed between a rear surface 128*b* of layer 128 and a front surface 114*a* of vehicle hull 114. Dispersion space 130 may be similar to dispersion space 30 of armor system 10 and hull 114 may be of a similar material as hull 14 of armor system 10.

Leading layer 120 may have a thickness, for example, of between about ⅛" and about ¾", and intermediate layer 122 may have a thickness, for example, of between about 4" and about 10". Intermediate layer 124 may have a thickness, for example, of between about ½" and about 4". Intermediate layers 126 and 128 may each have a thickness, for example, of between about ½" and about 2". Dispersion space 130 may have a width, for example, of between about ½" and 2".

Interior armor subsystem 118 may include an intermediate sheet-like layer 132 having synthetic fiber material. A front surface 132*a* of layer 132 may abut a rear surface 114*b* of vehicle hull 114. An adhesive having relatively high strength and relatively high elongation to break such as, for example, methacrylate adhesive may be applied to surfaces 114*b* and/or 132*a* to attach intermediate layer 132 to hull 114. Hull 114 may have a thickness, for example, of between about ¼" and about ¾". A vehicle interior 136 may be enclosed by a rear surface 132*b* of layer 132.

Layer 132 may include a synthetic fiber material such as, for example, a high strength aramid fiber material. For example, layer 132 may include a high strength aramid fiber material such as, for example, Kevlar®. Layer 132 may function to reduce spalling of components of armor system 100 such as, for example, spalling of vehicle hull 114. It is also contemplated that layer 132 may include an R-Glass composite in phenolic resin of a type that may be obtained, for example, from OCV™ Reinforcements. For example, layer 132 may include Quicksilver™, available from AGY. It is also contemplated that layer 132 may include an S-Glass material such as, for example, S-2™ and Featherlight™, available from AGY. It is further contemplated that layer 132 may also include an E-Glass composite material. It is further contemplated that layer 132 may include a composite material such as, for example, a Kevlar® reinforced polymer that may be infused with phenolic resin or a Kevlar® woven blanket material including a plurality of plies that may be woven together. It is also contemplated that layer 132 may include a polyethylene composite material. Layer 132 may have a thickness, for example, of between about ½" and about 2".

Figure 5:
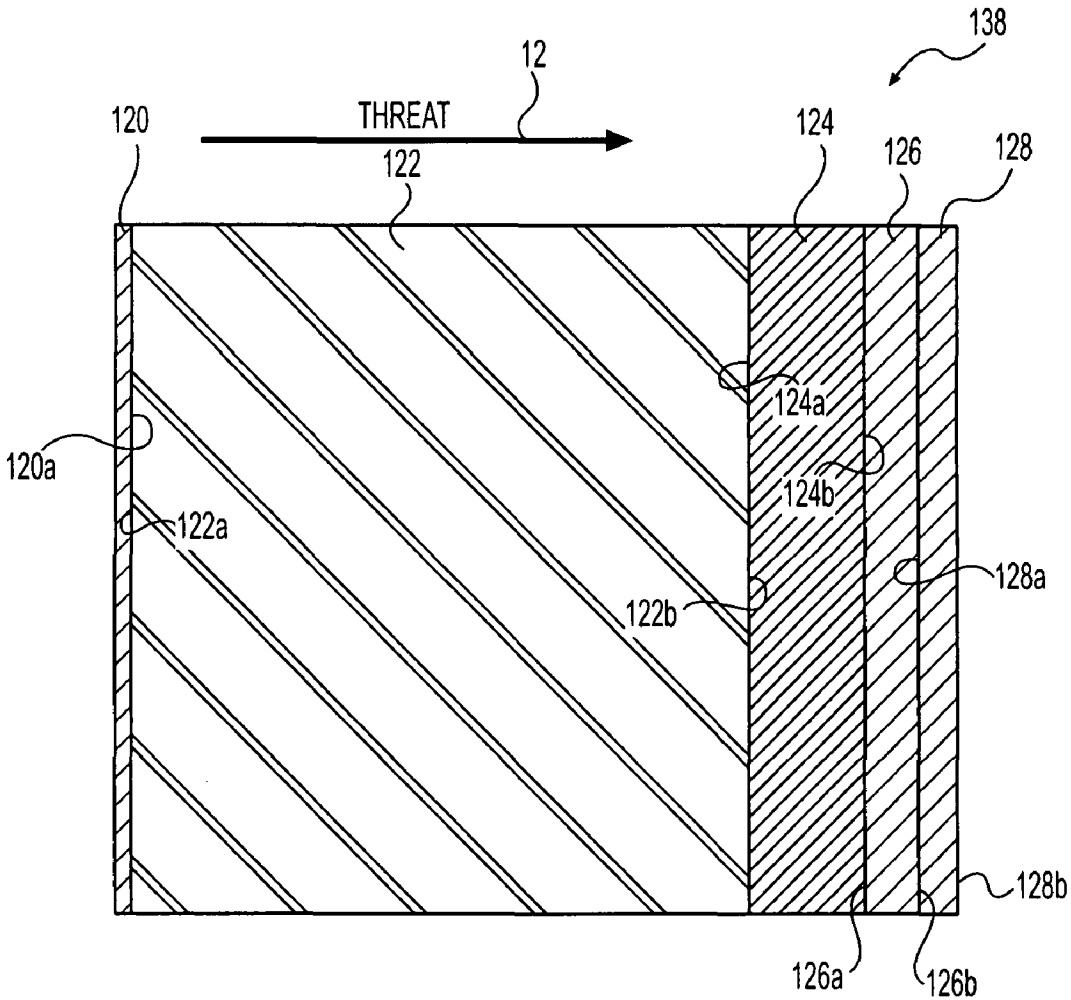
FIG. 5 is a schematic, cross-sectional view of an exemplary disclosed modular armor subsystem of the armor system of FIG. 4.

Armor system 100, depicted in FIG. 4, may include a modular armor subsystem 138, as illustrated in FIG. 5, which may include components of exterior armor subsystem 116. With reference to FIG. 5, modular armor subsystem 138 may include leading layer 120, intermediate layer 122, intermediate layer 124, intermediate layer 126, and intermediate layer 128. Layers 120, 122, 124, 126, and 128 may be attached to each other by any suitable method such as, for example, via adhesive having relatively high strength and relatively high elongation to break. For example, methacrylate adhesive, or any other suitable adhesive having high strength and high elongation to break, may be applied to the abutting surfaces to attach layers 120, 122, 124, 126, and 128 to each other. Adhesive may be applied to surfaces 120*a* and/or 122*a* to attach leading layer 120 to intermediate layer 122, to surfaces 122*b* and/or 124*a* to attach intermediate layer 122 to intermediate layer 124, to surfaces 124*b* and/or 126*a* to attach intermediate layer 124 to intermediate layer 126, and to surfaces 126*b* and/or 128*a* to attach intermediate layer 126 to intermediate layer 128.

Referring back to FIG. 4, armor system 100 may also include a permanent armor subsystem 140, which may include components of interior armor subsystem 118. Permanent armor subsystem 140 may include vehicle hull 114 and intermediate layer 132. Rear surface 128*b* of layer 128 of modular armor subsystem 138 may be attached to front surface 114*a* of hull 114 of permanent armor subsystem 140 by any known technique in the art such as, for example, via mechanical fasteners that may be disposed on front surface 114*a* of hull 114. Dispersion space 130 may be maintained by any suitable technique such as, for example, via mechanical spacers and/or a foam-like material. For example, modular armor subsystem 138 may be bolted to permanent armor subsystem 140, where dispersion space 130 is maintained via mechanical spacers and/or foam-like material.

Figure 6:
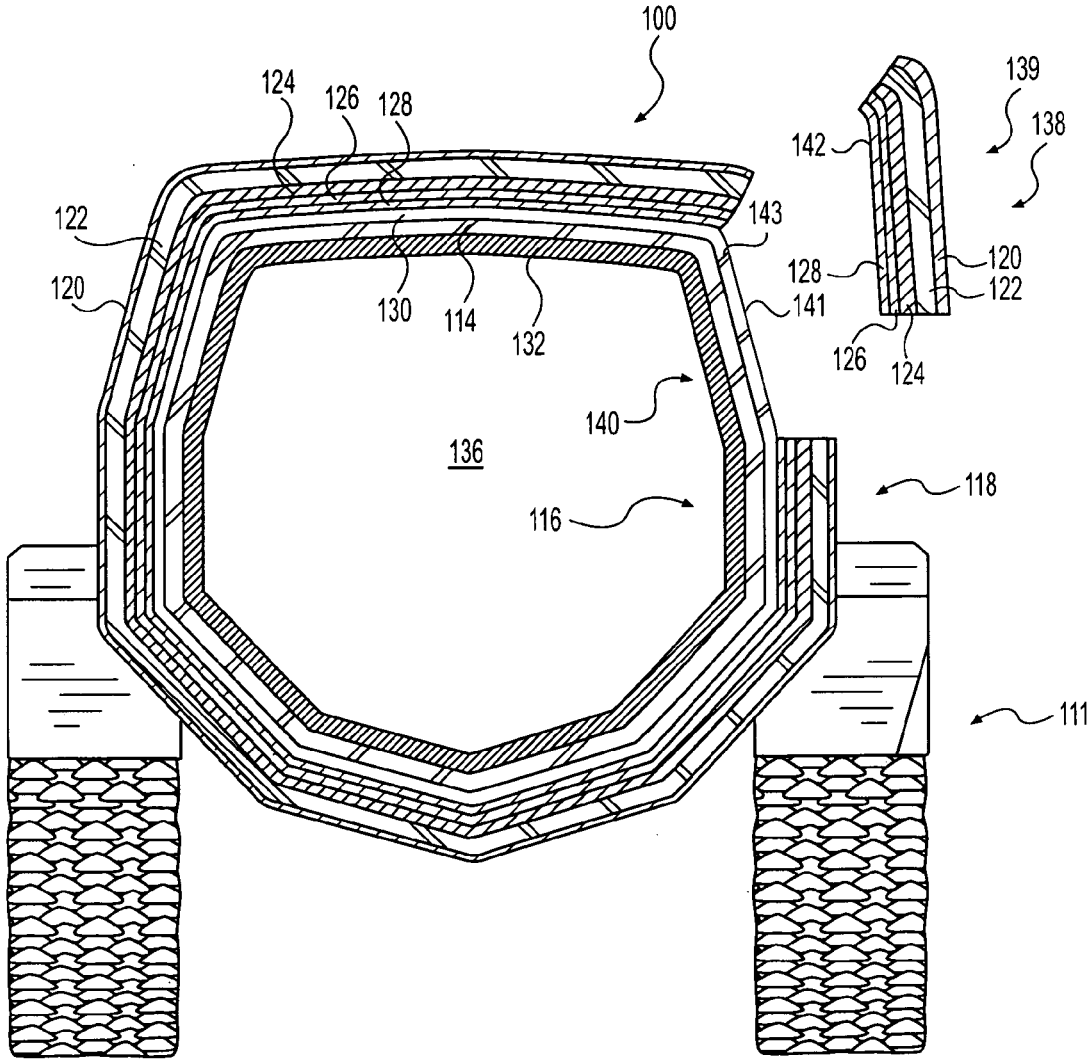
FIG. 6 is a schematic, cross-sectional view of a second exemplary disclosed vehicle.

As shown in FIG. 6, armor system 100 may be configured to protect vehicle interior 136 from projectiles. One or more panels 139 of modular armor subsystem 138 may be provided and removably attached to permanent armor subsystem 140 of vehicle 111. A surface 141 of permanent armor subsystem 140 may be configured to receive and bear flush against a surface 142 of a given panel 139. Surface 141 may be, for example, a surface of foam-like material disposed in dispersion space 130. Alternatively, surface 142 of a given panel 139 may be received by a plurality of mechanical spacers 143. Panel 139 may be planar and may be removably attached to permanent armor subsystem 140 that may be disposed on a side portion of vehicle 111. It is contemplated that panel 139 may be non-planar and include, for example, corners or curved portions. It is also contemplated that panel 139 may be removably attached to permanent armor subsystem 140 that may be disposed on a top or bottom portion of vehicle 111.

It will be apparent to those skilled in the art that various modifications and variations can be made to the disclosed apparatus and method. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. An armor system for protecting a vehicle from a projectile, the projectile having an expected trajectory and the vehicle having a hull, the armor system comprising:

a modular armor subsystem configured to be mounted exterior to the vehicle hull, the modular armor subsystem including (a) a leading layer having metal, leading relative to the expected projectile trajectory;

(b) an intermediate sheet-like layer having low density material selected from the group consisting of low density polypropylene composite material, Tegris®, reinforced polymer, reinforced plastic, polyethylene composite material, Dyneema®, and high molecular weight polyethylene fiber or tape, abutting a rear surface of the leading layer;

(c) an intermediate sheet-like layer having glass fiber material and abutting a rear surface of the intermediate low density material layer; and (d) an intermediate sheet-like layer having metal and abutting a rear surface of the intermediate glass fiber layer.

2. The armor system of claim 1, wherein the leading layer having metal includes one or more metals selected from high strength aluminum, copper, steel, stainless steel, magnesium, molybdenum, copper, zirconium, titanium, and nickel.

3. The armor system of claim 1, wherein the leading layer having metal has a thickness of between about ⅛" and about ¾".

4. The armor system of claim 1, wherein the intermediate sheet-like layer having low density material has a thickness of between about 8" and about 14".

5. The armor system of claim 1, wherein the intermediate sheet-like layer having glass fiber material includes R-Glass composite in phenolic resin.

6. The armor system of claim 1, wherein the intermediate sheet-like layer having glass fiber material has a thickness of between about ½" and about 4".

7. The armor system of claim 1, wherein the intermediate sheet-like layer having metal includes one or more metals selected from high strength aluminum, copper, steel, stainless steel, magnesium, molybdenum, copper, zirconium, titanium, and nickel.

8. The armor system of claim 1, wherein the intermediate sheet-like layer having metal has a thickness of between about ½" and about 2".

9. The armor system of claim 1, wherein an adhesive that includes methacrylate is disposed on at least one of the abutting surfaces of the layers of the modular armor subsystem.

10. An armor system for protecting a vehicle from a projectile, the projectile having an expected trajectory and the vehicle having a hull, the armor system comprising:

a modular armor subsystem configured to be mounted exterior to the vehicle hull, the modular armor subsystem including (a) a leading layer having metal, leading relative to the expected projectile trajectory;

(b) an intermediate sheet-like layer having low density material selected from the group consisting of low density polypropylene composite material, Tegris®, reinforced polymer, reinforced plastic, polyethylene composite material, Dyneema®, and high molecular weight polyethylene fiber or tape, abutting a rear surface of the leading layer;

(c) an intermediate sheet-like layer having glass fiber material and abutting a rear surface of the intermediate low density material layer;

(d) a first intermediate sheet-like layer having metal and abutting a rear surface of the intermediate glass fiber layer; and (e) a second intermediate sheet-like layer having metal and abutting a rear surface of the first intermediate metal layer.

11. The armor system of claim 10, wherein the leading layer having metal includes a high strength aluminum alloy.

12. The armor system of claim 10, wherein the leading layer having metal has a thickness of between about ⅛" and about ¾".

13. The armor system of claim 10, wherein the intermediate sheet-like layer having low density material has a thickness of between about 4" and about 10".

14. The armor system of claim 10, wherein the intermediate sheet-like layer having glass fiber material includes R-Glass composite in phenolic resin.

15. The armor system of claim 10, wherein the intermediate sheet-like layer having glass fiber material has a thickness of between about ½" and about 4".

16. The armor system of claim 10, wherein each of the first and second intermediate sheet-like layers having metal include one or more metals selected from high strength aluminum, copper, steel, stainless steel, magnesium, molybdenum, copper, zirconium, titanium, and nickel.

17. The armor system of claim 10, wherein each of the first and second intermediate sheet-like layers having metal has a thickness of between about ½" and about 2".

18. The armor system of claim 10, wherein an adhesive that includes methacrylate is disposed on at least one of the abutting surfaces of the layers of the modular armor subsystem.

19. An armor system for protecting a vehicle interior from a projectile having an expected trajectory, the armor system comprising:

(a) a leading layer, leading relative to the expected projectile trajectory;

(b) an intermediate sheet-like layer having low density material, selected from the group consisting of low density polypropylene composite material, Tegris®, reinforced polymer, reinforced plastic, polyethylene composite material, Dyneema®, and high molecular weight polyethylene fiber or tape, abutting a rear surface of the leading layer;

(c) an intermediate sheet-like layer having glass fiber material and abutting a rear surface of the intermediate low density material layer;

(d) a first intermediate sheet-like layer having metal and abutting a rear surface of the intermediate glass fiber layer;

(e) a second intermediate sheet-like layer having metal and abutting a rear surface of the first intermediate metal layer;

(f) a third intermediate sheet-like layer having metal and disposed approximately parallel to the second intermediate metal layer and displaced therefrom to form a first dispersion space between the second intermediate metal layer and the third intermediate metal layer, the first dispersion space being sufficiently thick to allow significant lateral dispersion of material passing through the first dispersion space; and (g) an intermediate sheet-like layer having polymer material disposed approximately parallel to the third intermediate metal layer and displaced therefrom to form a second dispersion space between the third intermediate metal layer and the intermediate polymer layer, the second dispersion space being sufficiently thick to allow significant lateral dispersion of material passing through the second dispersion space.

20. The armor system of claim 19, wherein the second intermediate sheet-like layer having metal includes one or more metals selected from high strength aluminum, copper, steel, stainless steel, magnesium, molybdenum, copper, zirconium, titanium, and nickel.

21. The armor system of claim 19, wherein the second intermediate sheet-like layer having metal has a thickness of between about ½" and about 2".

22. The armor system of claim 19, wherein the third intermediate sheet-like layer having metal is a vehicle hull having 500 Brinell hardness steel.

23. The armor system of claim 19, wherein the third intermediate sheet-like layer having metal has a thickness of between about ¼" and about ¾".

24. The armor system of claim 19, wherein the intermediate sheet-like layer having polymer material includes a polyethylene composite material.

25. The armor system of claim 19, wherein the intermediate sheet-like layer having polymer material has a thickness of between about ½" and about 2".

26. The armor system of claim 19, wherein at least one of a mechanical spacer or a foam-like material is disposed in the first and second dispersion spaces.

27. The armor system of claim 19, wherein each of the first and second dispersion spaces has a width of between about ½" and about 2".

* * * * *